US007034466B2

(12) United States Patent
Tsao

(10) Patent No.: US 7,034,466 B2
(45) Date of Patent: Apr. 25, 2006

(54) STANDBY LIGHTING CONTROL FOR HIGH INTENSITY DISCHARGE LAMP

(76) Inventor: Frank Tsao, 5 Marram Ct., Cleveland, QLD 4163 (AU)

( * ) Notice: Subject to any disclaimer, the term of this patent is extended or adjusted under 35 U.S.C. 154(b) by 63 days.

(21) Appl. No.: 10/810,951

(22) Filed: Mar. 25, 2004

(65) Prior Publication Data

US 2005/0212455 A1 Sep. 29, 2005

(51) Int. Cl.
*H05B 37/00* (2006.01)

(52) U.S. Cl. ..... 315/88; 362/236

(58) Field of Classification Search ..... 315/86–92; 307/64–66; 362/236–237, 241
See application file for complete search history.

(56) References Cited

U.S. PATENT DOCUMENTS 4,751,398 A * 6/1988 Ertz, III ..... 307/66

5,526,237 A * 6/1996 Davenport et al. ..... 362/551

* cited by examiner

*Primary Examiner*—David Vu
(74) *Attorney, Agent, or Firm*—Raymond Y. Chan; David & Raymond

(57) ABSTRACT

A High-Intensity Discharge lamp which includes a high intensity discharge light disposed within the light cavity and a standby lighting control system including a light sensor for detecting a light intensity within the light cavity and a standby lamp which is supported within the lamp housing and is activated by the light sensor between a standby mode and a backup mode, wherein at the standby mode, when the light intensity of the high intensity discharge light within the light cavity is above a predetermined threshold, the standby lamp is deactivated, and at the backup mode, when the light intensity of the high intensity discharge light within the light cavity is dropped below the threshold, the standby lamp is activated for generating a backup light to compensate a loss of the light intensity of the high intensity discharge light.

17 Claims, 3 Drawing Sheets

STANDBY LIGHTING CONTROL FOR HIGH INTENSITY DISCHARGE LAMP

BACKGROUND OF THE PRESENT INVENTION

1. Field of Invention

The present invention relates to a High-Intensity Discharge (HID) lamp, and more particularly to a standby lighting control for the HID lamp which is arranged to provide illumination when the HID lamp is in re-striking state after a sudden lapse of power.

2. Description of Related Arts

High-Intensity Discharge (HID) lamps are widely used for lighting streets, highways, parking lots, stadiums, high-bay factories and more recently have come into use for department store and office lighting. Conventionally, there exist a three principal types of HID lamps, which are high pressure mercury vapor lamps, mercury metal halide lamps, and high pressure sodium lamps.

The HID lamps operate at a completely different principle from conventional light bulbs. Electrical discharge, created by a predetermined current, between electrodes of the HID lamps causes the filler materials in the discharge tube to emit light. The light is generated directly by an arc discharge. The filler materials utilized depend on the type of the HID lamp used. For example, for mercury vapor lamp, the filler material is high pressure pure mercury.

As a matter of fact, the HID lamps significantly overcome the practical limitations of conventional light bulbs and provide a long-lasting and high intensity discharge light source in many situations which require its existence. For example, it could hardly to find an alternative in the current technology to replace the HID lamps used in a football stadium for providing excellent illumination in the course of a football game.

Conversely, as a matter of fact too, the conventional HID lamps also have some practical limitations, even in the context of their intended operation. Among those the fatal disadvantage is that as conventional HID lamps work in very high frequency and pressure, upon being turned on, all of these lamps require several minutes to achieve their normal or the peak brightness, during which period of time the filler materials are building up in pressure. As a result, unlike conventional light bulbs in which normal brightness can be acquired once they are turned on, conventional HID lamps operate in such a manner that a grace period is need for them to achieve their normal brightness after being turned on. Typically, the grace period should be in the range of 15 minutes to 30 minutes.

The requirement of the grace period is actually not a big deal per se. Provided that a predetermined grace period is available prior to their actual uses, it won't affect the ultimate operation of the HID lamps. Since the HID lamps possess a large number of advantages over conventional light bulbs, this disadvantage of the requirement of a grace period can be well balanced and becomes an immaterial one. The problem becomes intolerable when there is something wrong with the power system to which the HID lamps connect.

Upon momentary power interruptions or an appreciable drop in line voltage, the lamps may extinguish due to insufficient power. Once extinguished, the lamps cannot be restarted with the normal brightness until the pressure of the filler materials has dropped in order to be reignited to regain the normal brightness. For most conventional types of HID lamps, this re-striking period will take several minutes and it frequently takes as much as 10 to 15 minutes.

This 10 to 15 minutes declination in brightness may cause disastrous effect to the event for which the HID lamps provide illumination. For example, the effect of a sudden power interruption causing brightness declination is most noticeable in sports events in a stadium which is also usually broadcasted to all over the nation. Very often, the power interruption lasts for only a very short period of time, such as 0.5 s to 1s, which is usually insufficient for, say a referee, to terminate the event. And, as a result, when the power resumes, with the illumination intensity substantially declined, the organizer of the event will be in a very embarrassing position to decide whether or not such an event needs termination, especially when the organizer knows for sure that the brightness will resume after the grace period.

Obviously, surge protectors offer protection to power lapse at such. However, when the time of lapse is such that the electrical storage time limit of the power protectors is exceeded, the HID lamps will eventually be extinguished and the above-mentioned problem surfaces again.

SUMMARY OF THE PRESENT INVENTION

A main object of the present invention is to provide a High-Intensity Discharge lamp which comprises a standby lighting control system arranged to provide illumination when the main HID lamp is in re-striking state after a sudden lapse of power.

Another object of the present invention is to provide a High-Intensity Discharge lamp, wherein the standby lighting control system which is capable of detecting a sudden drop in voltage supplied through a declination of brightness and accordingly lights up a standby lamp such that when the main HID is getting dimmer or even goes out, the standby lamp will become effective and provide adequate illumination until the HID is re-struck to its normal brightness again.

Another object of the present invention is to provide a High-Intensity Discharge lamp, wherein the standby lighting control system automatically lighting up a standby lamp in sudden power lapse until the main HID resumes its normal brightness, so that the undesirable effect of temporary declination of brightness of the main HID can be minimized.

Another object of the present invention is to provide a High-Intensity Discharge lamp wherein the standby lighting control system comprises a light sensor for detecting the light intensity of the high intensity discharge light such that when the light intensity of the high intensity discharge light is dropped below a predetermined threshold, the standby lamp is automatically activated for generating a backup light to compensate a loss of the light intensity of the high intensity discharge light.

Another object of the present invention is to provide a High-Intensity Discharge lamp, wherein the standby lighting control system does not significantly alter the original design and structure of the main HID lamp, so that the standby lighting control can be easily incorporated into the conventional HID lamp.

Another object of the present invention is to provide a High-Intensity Discharge lamp, wherein the standby lighting control system which does not involve expensive mechanical and electronic components so as to minimize the manufacturing and the ultimate selling price of the present invention.

Accordingly, in order to accomplish the above objects, the present invention provides a High-Intensity Discharge (HID) lamp, comprising:

a lamp housing having a receiving chamber;

a light reflector supported within the receiving chamber and defining a light cavity within the light reflector;

a high intensity discharge light disposed within the light cavity of the light reflector for producing lights having a predetermined light intensity; and a standby lighting control system, comprising:

a light sensor disposed within the receiving chamber for detecting the light intensity of the high intensity discharge light within the light cavity; and a standby lamp which is supported within the lamp housing and is activated by the light sensor between a standby mode and a backup mode, wherein at the standby mode, the light intensity of the high intensity discharge light within the light cavity is above a predetermined threshold, such that the standby lamp is deactivated, and at the backup mode, the light intensity of the high intensity discharge light within the light cavity is below a predetermined threshold, such that the standby lamp is activated for generating a backup light to compensate a loss of the light intensity of the high intensity discharge light.

These and other objectives, features, and advantages of the present invention will become apparent from the following detailed description, the accompanying drawings, and the appended claims.

DETAILED DESCRIPTION OF THE PREFERRED EMBODIMENT

Figure 1:
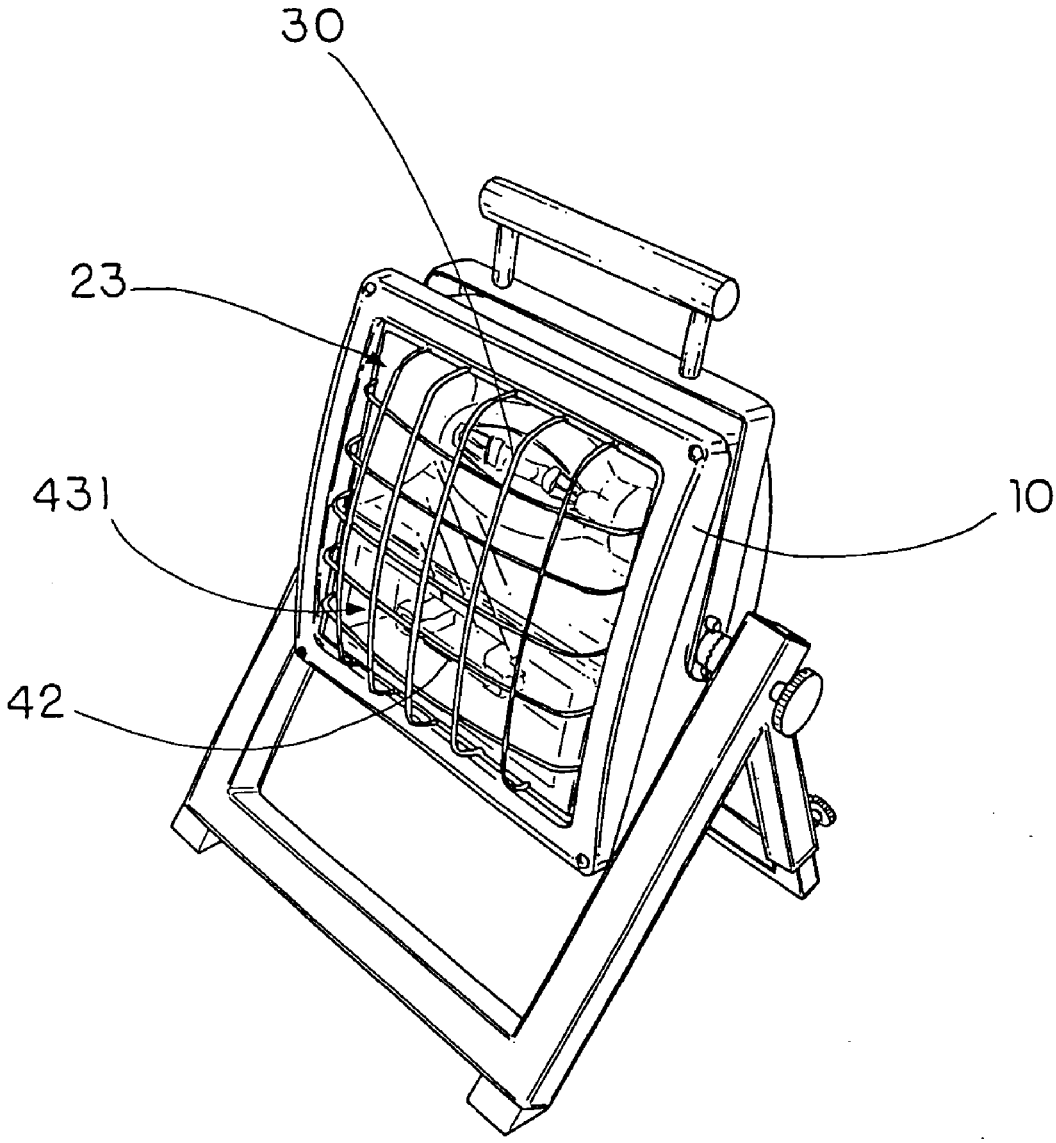
FIG. 1 is a perspective view of a High Intensity Discharge (HID) lamp according to a preferred embodiment of the present invention.
Figure 2:
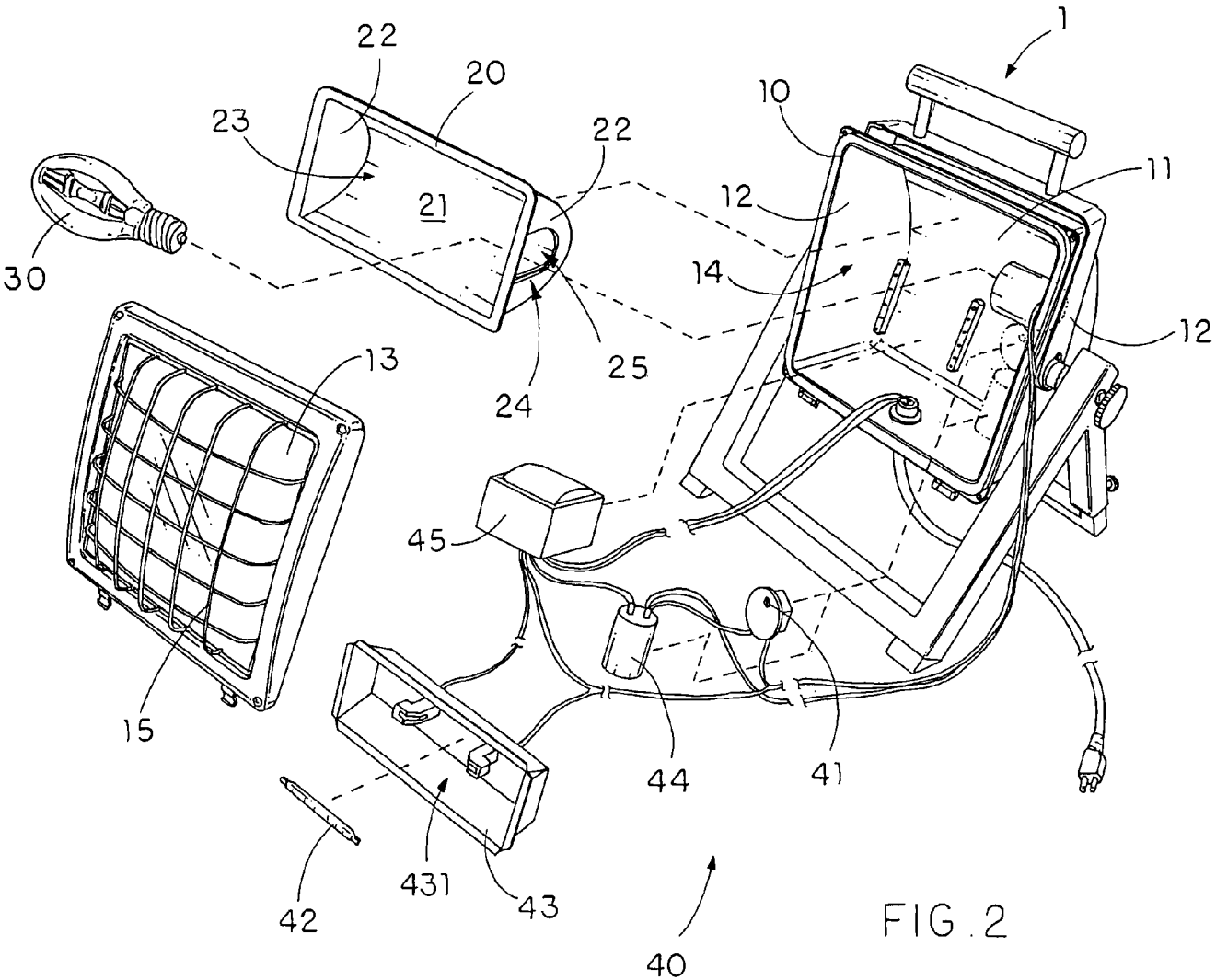
FIG. 2 is an exploded perspective view of the HID lamp according to the above preferred embodiment of the present invention.

Referring to FIG. 1 and FIG. 2 of the drawings, a High-Intensity Discharge (HID) lamp 1 according to a preferred embodiment of the present invention is illustrated, in which the HID lamp 1 comprises a lamp housing 10 having a receiving chamber 14, a light reflector 20 supported within the receiving chamber 14 and defining a light cavity 23 within the light reflector 20, and a high intensity discharge light 30 disposed within the light cavity 23 of the light reflector 20 for producing a main light having a predetermined light intensity.

The High-Intensity Discharge lamp 1 further comprise a standby lighting control system 40 comprising a light sensor 41 disposed within the receiving chamber 14 for detecting the light intensity of the high intensity discharge light 30 within the light cavity 23, and a standby lamp 42 which is supported within the lamp housing 10 and is activated by the light sensor 41 between a standby mode and a backup mode. In which, at the standby mode, the light intensity of the high intensity discharge light 30 within the light cavity 23 is above a predetermined threshold, such that the standby lamp 42 is deactivated, and at the backup mode, the light intensity of the high intensity discharge light 30 within the light cavity is dropped below the threshold, such that the standby lamp 42 is activated for generating a backup light to compensate a loss of the light intensity of the high intensity discharge light 30.

According to the preferred embodiment, the lamp housing 10 has a rear wall 11, four sidewalls 12 and a front transparent cover 13, which is preferably embodied as a transparent glass, to define the receiving chamber 14 within the rear wall 11, the four sidewalls 12 and the front transparent cover 13, wherein the light reflector 20, the high intensity discharge light 30, and the standby lighting control system 40 are received in the receiving chamber 14 in such a manner that high intensity light generated by the high intensity discharge light 30 is then capable of reaching out of the lamp housing 10 through the front transparent cover 13. Moreover, the high intensity discharge lamp 1 further comprises a protection frame 15 mounted on the front transparent cover 13 for protection purposes.

The light reflector 20 has a light gap 24 formed thereon for allowing the main light passing out from the light cavity 23 to outside through the light gap 24, wherein the light sensor 41 is positioned adjacent to the light gap 24 within the receiving chamber 14 at a position out of the light cavity 23 to optically communicate with the light cavity 23 through the light gap 24.

The light reflector 20 is supported within the receiving chamber 14, and has a rear concave reflective surface 21, and two side reflective surfaces 22 to define the light cavity 23 within the rear concave reflective surface 21 and the side reflective surfaces 22, wherein the light gap 24 is formed at one of the side reflective surface 22 to communicate the light cavity 23 with the light sensor 41.

Figure 3:
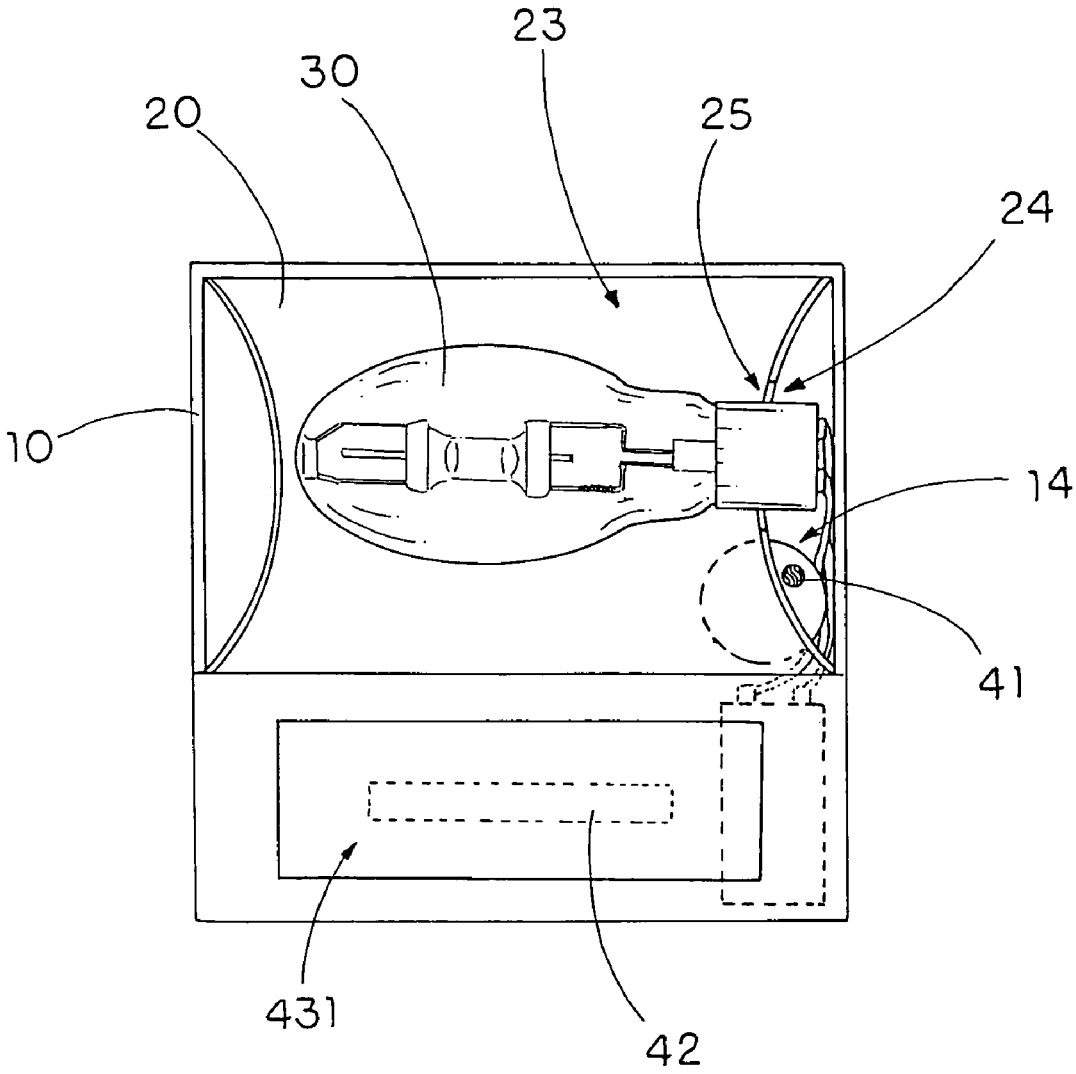
FIG. 3 is a sectional view of the HID lamp according to the above preferred embodiment of the present invention.

As shown in FIG. 3, the light reflector 20 further has a guiding hole 25 formed on the respective side reflective surface 22 of the light reflector 20, wherein the high intensity discharge light 30 is mounted on the respective sidewall 12 of the lamp housing 10 and longitudinally extended into the light cavity 23 through the guiding hole 25 to define the light gap 24 between a clearance between a circumferential edge of the guiding hole 25 and the high intensity discharge light 30.

According to the preferred embodiment, the high intensity discharge light 30 is mounted within the receiving chamber 14 and extending into the light cavity 23 through the light gap 24 so as to receive in the light cavity 23 for generating high-intensity illumination. Accordingly, when the main light is generated, most of which being reflected by the rear concave reflective surfaces 21 and the side reflective surfaces 22 to project outside of the lamp housing 10 through the front transparent cover 13. Furthermore, a small amount of the main light generated in the light cavity 23 is projecting towards the standby lighting control system 40 through the light gap 24 to communicate with the light sensor 41.

The high intensity discharge light 30 is preferably embodied as a regular high intensity discharge light which comprises a discharge tube filled with a predetermined kind of filler materials, such as pure mercury vapor, at a predetermined pressure and temperature, wherein an electric current is arranged to pass the electrodes on the discharge tube so that filler materials therein are energized to discharge illumination so as to emit high intensity light through the discharge tube. However, it is worth to mention that, in order that the high intensity discharge light 30 to be fully performed, it takes a predetermined period of time, known as a light period, which is usually 15 to 30 minutes, and during which the filler materials inside the discharge tube is gaining pressure and temperature.

It is also worth to mention that during the course of the normal operation of the high intensity discharge light 30, if there exist a sudden lapse of electric current, the high intensity discharge light 30 is suddenly turned off and on in a very short period of time, usually less than 1 s, and the high intensity discharge light 30 will be unable to re-strike to resume to its usual brightness as just prior to the electric current is lapsed until the predetermined of lighting time is passed. During that lighting period, the filler materials inside the discharge tube will be gaining pressure. In other words, the high intensity discharge light 30 requires a period of re-striking time to re-strike so as to re-gain its normal light intensity.

According to the preferred embodiment, the light sensor 41 is a photocell functioning as a light switch to automatically activate the standby lamp 42 when the photocell of the light sensor 41 detects the light intensity of the high intensity discharge light 30 within the light cavity 23 is below the predetermined threshold.

Accordingly, the predetermined threshold is preset at a level of 60% of a normal light intensity of the high intensity discharge light 30, i.e. the high intensity discharge light 30 normally operates. In other words, when the light intensity of the high intensity discharge light 30 drops below 60% of that of the normal light intensity, due to perhaps a sudden lapse of electric current, the standby lamp 42 will be at the backup mode and is activated for generating the backup light to compensate a loss of the light intensity in the high intensity discharge light 30. Conversely, if the high intensity discharge light 30 operates at a light intensity which is above 60% of its normal light intensity, the standby lamp 42 will be deactivated and stay in the standby mode, meaning that the high intensity discharge light 30 has sufficient light intensity for providing adequate illumination.

Referring to FIG. 2 and FIG. 3 of the drawings, the light sensor 41 is mounted on the lamp housing 10 in the receiving chamber 14 out of the light cavity 23 in such a manner that light generated in the light cavity 23 is capable of reaching the light sensor 41 through the light gap 24. In other words, part of the light generated in the light cavity 23 will reach the light sensor 41 via the light gap 24 where its light intensity is detected.

The standby lighting control system 40 further comprises a backup light reflector 43 which is supported in the receiving chamber 14 at a position adjacent to the light reflector 20 and defines a backup light cavity 431 within the backup light reflector 43, wherein the standby lamp 42 is disposed within the backup light cavity 431 and electrically connected to the light sensor 41 for substantially reflecting the backup light from the standby lamp 42 to outside.

The standby lamp 42 is preferably embodied as a regular halogen lamp (quartz lamp) of 150 W to 200 W, depending on the power and size of the high intensity discharge light 30, wherein the standby lamp 42 is electrically connected to the light sensor 41 to generate the backup light having a light intensity lower than the light intensity of the high intensity discharge light 30. Accordingly, the standby lamp 42 generally comprises an envelope which is usually filled with halogen, and has a quartz wire extending therein. When an electric current is passed, the quartz lamp will generate illumination which is then utilized to compensate a loss of the light intensity from the high intensity discharge light 30.

In order to deal with emergency situation, such as a sudden blackout, the standby lighting control system 40 further comprises a rechargeable backup battery 44 disposed in the receiving chamber 14 and electrically connected to the standby lamp 42, in such a manner that when the light intensity in the light cavity 23 drops to zero, representing that the electricity may be cut off altogether, the backup battery 44 is arranged to supply electricity to the standby lamp 42 so as to activate it for providing a backup illumination.

According to the preferred embodiment, the operation of the present invention is as follows: when the high intensity discharge lamp 1 is turned on, preferably through a transformer 45 electrically connected to an external power source, it takes around 15 to 20 minutes, known as the lighting period, for the high intensity discharge light 30 to substantially achieve its normal brightness, i.e. the normal light intensity. After the lighting period, if there is nothing wrong with the electric circuit with which the high intensity discharge lamp 1 connects, the high intensity discharge light 30 should operate normally and deliver its normal degree of illumination. As such, the light sensor 41 should detect an adequate amount of light intensity in the light cavity 23 and the standby lamp 42 should be in the standby mode.

If during the course of the normal operation, the high intensity discharge lamp 1 encounters a sudden lapse of power supply, or a deterioration of power supply, the high intensity discharge light 30, its light intensity being dependent on electric current applied, will suffer declining light intensity. Therefore, the high intensity discharge light 30 of the high intensity discharge lamp 1 requires a period of re-striking time to re-strike the high intensity discharge 30 back to its normal condition.

As a result, the light sensor 41 will then notice that there is decline drop of light intensity and when the light intensity drops below 60% of the normal light intensity, the light sensor 41 will activate the standby lamp 42 to the backup mode that the standby lamp 42 will provide extra illumination in order to compensate the loss of light intensity of the high intensity discharge light 30.

In other words, in case where the electric supply resumes, the high intensity discharge light 30 will take the lighting time period to resume to its normal light intensity, and during this time period, the standby lamp 42 will continue to light up until the light intensity of the high intensity discharge light 30 is over 60% of its normal light intensity, as detected by the light sensor 41. Then the light sensor 41 will deactivate the standby lamp 42 and turns it into the standby mode.

Moreover, the high intensity discharge lamp 1 of the present invention is utilized as a work lamp, as shown in FIG. 1 of the drawings, wherein the high intensity discharge lamp 1 is incorporated with a lamp stand mounted on two sides of the lamp housing 10 in such a manner that the lamp housing 10 is supported in a pivotally movable manner with respect to the lamp stand. For example, when the high intensity discharge lamp 1 of the present invention is used as an illumination device for road construction, the high intensity discharge lamp 1 provides sufficient light intensity even though the high intensity discharge light 30 needs to re-strike. It is worth to mention that no re-strike system is needed for the high intensity discharge lamp 1 to speed up the re-striking period thereof because the standby lighting control system 40 provides the backup light to compensate a loss of the light intensity of the high intensity discharge light 30 until the high intensity discharge light 30 returns to its normal condition. Therefore, the high intensity discharge lamp 1 of the present invention provides sufficient light intensity during the re-striking period of the high intensity discharge light 30.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A High-Intensity Discharge lamp, comprising:

a lamp housing having a receiving chamber;

a light reflector supported within said receiving chamber and defining a light cavity within said light reflector;

a high intensity discharge light disposed within said light cavity of said light reflector for producing a main light having a predetermined light intensity; and a standby lighting control system, comprising:

a light sensor disposed within said receiving chamber for detecting said light intensity of said high intensity discharge light within said light cavity; and a standby lamp which is supported within said lamp housing and is activated by said light sensor between a standby mode and a backup mode, wherein at said standby mode, when said light intensity of said high intensity discharge light within said light cavity is reached above a predetermined threshold, said standby lamp is deactivated, and at said backup mode, when said light intensity of said high intensity discharge light within said light cavity is dropped below said predetermined threshold, said standby lamp is activated for generating a backup light to compensate a loss of said light intensity of said high intensity discharge light, wherein said light reflector has a light gap formed thereon for allowing said main light passing out from said light cavity to outside through said light gap, wherein said light sensor is positioned adjacent to said light gap within said receiving chamber at a position out of said light cavity to optically communicate with said light cavity through said light gap.

2. The High-Intensity Discharge lamp, as recited in claim 1, wherein said light reflector has a rear concave reflective surface and two side reflective surfaces to define said light cavity within said rear concave reflective surface and said side reflective surfaces, wherein said light gap formed at one of said side reflective surfaces to communicate said light cavity with said light sensor.

3. The High-intensity Discharge lamp, as recited in claim 2, wherein said light reflector further has a guiding hole formed on said respective side reflective surface, wherein said high intensity discharge light is mounted on a sidewall of said lamp housing and is longitudinally extended into said light cavity through said guiding hole to define said light gap at a clearance between a circumferential edge of said guiding hole and said high intensity discharge light.

4. The High-Intensity Discharge lamp, as recited in claim 1, wherein said light sensor is a photocell functioning as a light switch to automatically activate said standby lamp when said photocell detects said light intensity of said high intensity discharge light within said light cavity is below a predetermined threshold.

5. The High-Intensity Discharge lamp, as recited in claim 3, wherein said light sensor is a photocell functioning as a light switch to automatically activate said standby lamp when said photocell detects said light intensity of said high intensity discharge light within said light cavity is below a predetermined threshold.

6. The High-Intensity Discharge lamp, as recited in claim 3, wherein said predetermined threshold is preset at a level of 60% of a normal light intensity of said high intensity discharge light, such that when said light intensity within said light cavity is above said 60% of said normal light intensity of said high intensity discharge light, said standby lamp is activated to said backup mode, and when said light intensity within said light cavity is below said 60% of said normal light intensity of said high intensity discharge light, said standby lamp is activated to said standby mode.

7. The High-Intensity Discharge lamp, as recited in claim 5, wherein said predetermined threshold is preset at a level of 60% of a normal light intensity of said high intensity discharge light, such that when said light intensity within said light cavity is above said 60% of said normal light intensity of said high intensity discharge light, said standby lamp is activated to said backup mode, and when said light intensity within said light cavity is below said 60% of said normal light intensity of said high intensity discharge light, said standby lamp is activated to said standby mode.

8. The High-Intensity Discharge lamp, as recited in claim 1, wherein said standby lighting control system further comprises a backup light reflector which is supported in said receiving chamber at a position adjacent to said light reflector and defines a backup light cavity within said backup light reflector, wherein said standby lamp is disposed within said backup light cavity for substantially reflecting said backup light from said standby lamp to outside.

9. The High-Intensity Discharge lamp, as recited in claim 5, wherein said standby lighting control system further comprises a backup light reflector which is supported in said receiving chamber at a position adjacent to said light reflector and defines a backup light cavity within said backup light reflector, wherein said standby lamp is disposed within said backup light cavity for substantially reflecting said backup light from said standby lamp to outside.

10. The High-Intensity Discharge lamp, as recited in claim 7, wherein said standby lighting control system further comprises a backup light reflector which is supported in said receiving chamber at a position adjacent to said light reflector and defines a backup light cavity within said backup light reflector, wherein said standby lamp is disposed within said backup light cavity for substantially reflecting said backup light from said standby lamp to outside.

11. The High-Intensity Discharge lamp, as recited in claim 8, wherein said standby lamp is a halogen lamp which is disposed within said backup light cavity and is electrically connected to said light sensor to generate said backup light having a light intensity lower than said light intensity of said high intensity discharge light.

12. The High-Intensity Discharge lamp, as recited in claim 9, wherein said standby lamp is a halogen lamp which is disposed within said backup light cavity and is electrically connected to said light sensor to generate said backup light having a light intensity lower than said light intensity of said high intensity discharge light.

13. The High-Intensity Discharge lamp, as recited in claim 10, wherein said standby lamp is a halogen lamp which is disposed within said backup light cavity and is electrically connected to said light sensor to generate said backup light having a light intensity lower than said light intensity of said high intensity discharge light.

14. The High-Intensity Discharge lamp, as recited in claim 5, wherein said standby lighting control system further comprises a rechargeable backup battery disposed in said receiving cavity and electrically connected with said standby lamp to electrically backup said standby lamp when an electric supply to said HID lamp is temporarily cut off.

15. The High-Intensity Discharge lamp, as recited in claim 7, wherein said standby lighting control system further comprises a rechargeable backup battery disposed in said receiving cavity and electrically connected with said standby lamp to electrically backup said standby lamp when an electric supply to said HID lamp is temporarily cut off.

16. The High-Intensity Discharge lamp, as recited in claim 13, wherein said standby lighting control system further comprises a rechargeable backup battery disposed in said receiving cavity and electrically connected with said standby lamp to electrically backup said standby lamp when an electric supply to said HID lamp is temporarily cut off.

17. A High-Intensity Discharge lamp, comprising:

a lamp housing having a receiving chamber;

a light reflector supported within said receiving chamber and defining a light cavity within said light reflector;

a high intensity discharge light disposed within said light cavity of said light reflector for producing a main light having a predetermined light intensity; and a standby lighting control system, comprising:

a light sensor disposed within said receiving chamber for detecting said light intensity of said high intensity discharge light within said light cavity; and a standby lamp which is supported within said lamp housing and is activated by said light sensor between a standby mode and a backup mode, wherein at said standby mode, when said light intensity of said high intensity discharge light within said light cavity is reached above a predetermined threshold, said standby lamp is deactivated, and at said backup mode, when said light intensity of said high intensity discharge light within said light cavity is dropped below said predetermined threshold, said standby lamp is activated for generating a backup light to compensate a loss of said light intensity of said high intensity discharge light, wherein said predetermined threshold is preset at a level of 60% of a normal light intensity of said high intensity discharge light, such that when said light intensity within said light cavity is above said 60% of said normal light intensity of said high intensity discharge light, said standby lamp is activated to said backup mode, and when said light intensity within said light cavity is below said 60% of said normal light intensity of said high intensity discharge light, said standby lamp is activated to said standby mode.

* * * * *